US006557777B1

(12) United States Patent
Pevnick

(10) Patent No.: US 6,557,777 B1
(45) Date of Patent: May 6, 2003

(54) WATER SUPPLY METHOD AND APPARATUS FOR A FOUNTAIN

(75) Inventor: Stephen H. Pevnick, Milwaukee, WI (US)

(73) Assignee: Pevnick Design, Inc., Milwaukee, WI (US)

( * ) Notice: Subject to any disclaimer, the term of this patent is extended or adjusted under 35 U.S.C. 154(b) by 0 days.

(21) Appl. No.: 10/122,503

(22) Filed: Apr. 15, 2002

(51) Int. Cl.[7] ..... F21S 8/00
(52) U.S. Cl. ..... 239/20; 239/562
(58) Field of Search ..... 239/16, 17, 20–23, 239/67, 69, 71, 74, 24, 551, 562, 569, 585.1; 40/411, 412; 251/125, 129.01; 137/624.11

(56) References Cited

U.S. PATENT DOCUMENTS

| | | | | |
|---|---|---|---|---|
| 4,294,406 A | 10/1981 | Pevnick | ..... | 239/20 |
| 5,524,822 A | 6/1996 | Simmons | ..... | 239/17 |
| 5,737,860 A | 4/1998 | Whigham et al. | ..... | 40/406 |
| RE35,866 E | 8/1998 | Simmons | ..... | 239/17 |
| 6,053,423 A | 4/2000 | Jacobsen et al. | ..... | 239/18 |
| 6,196,471 B1 | 3/2001 | Ruthenberg | ..... | 239/18 |

*Primary Examiner*—Lisa A. Douglas
(74) *Attorney, Agent, or Firm*—Whyte Hirschboeck Dudek SC

(57) ABSTRACT

A method and system for maintaining desired water levels in a gravity flow fountain. The fountain includes manifolds that define reservoirs for storing water. The fountain is capable of generating displays by expelling variably sized and arranged water droplets, at varying rates, from the reservoirs. The expelled water must be replaced in the reservoir to continue sustained operation of the fountain. Even though the volume of water needed at each reservoir as the fountain operates is non-constant and varying, the water is controllable, and therefore, predictable. The fountain uses a programmable logic device, in combination with a variety of components, to anticipate the need for water in the reservoirs. The fountain can also use programmable logic devices, in combination with sensors and a variety of components, to historically determine the need for water in the reservoirs or meet water supply demands on a real time basis.

20 Claims, 5 Drawing Sheets

WATER SUPPLY METHOD AND APPARATUS FOR A FOUNTAIN

BACKGROUND OF THE INVENTION

1. Field of the Invention

The present invention relates to a gravity flow fountain and, more particularly to a method of, and apparatus for, supplying water to a gravity flow fountain.

2. Description of Related Art

Gravity flow fountains of various designs and configurations can generate a display comprising a cascade of water droplets. These water droplets, when grouped together and properly synchronized, assume or compose various shapes, images, and/or messages.

In general, gravity flow fountains capable of generating these displays arc known in the art. By way of example, U.S. Pat. No. 6,196,471 to Ruthenberg discloses an apparatus for providing a waterfall or fountain capable of making displays formed from water droplets. Further, U.S. Pat. No. 6,053,423 to Jacobsen, U.S. Pat. No. 5,524,822 to Simmons, and U.S. Pat. No. RE35,866 to Simmons teach methods of producing fountain images and displays using nozzles or timely released, gravity-affected droplets. Additionally, U.S. Pat. No. 5,737,860 to Whigham discloses a method and apparatus employing gravity to display a message.

To ensure that the displays are properly produced, a consistent and reliable supply of water must be provided to one or more water reservoirs within the fountain. Failure to properly replenish water expelled from these reservoirs can result in displays being malformed. Thus, the aesthetic qualities and advertising capabilities of the fountain can be compromised. As displays produced by the fountain increase in complexity, the adequate and timely supply of water becomes more critical to preserve and maintain a cohesive and coordinated water droplet display.

One method of providing water to a reservoir within a fountain includes oversupplying each of the reservoirs with water. By providing a continual overabundance of water, the reservoirs can remain filled. However, this approach dramatically increases the cost of operating the fountain. For example, large and expensive equipment (e.g., pumps, fill valves, etc.) must be purchased and serviced, a large volume of water must be accessed or transported with the fountain, and a burdensome amount of energy is required to operate the fountain.

In addition to adding undesirable expense, the oversupplying method fails to recognize or appreciate sudden or unpredictable needs for an increased, or decreased, amount of water at one reservoir relative to another reservoir. Consequently, water supply systems that rely on the oversupply method cannot disproportionately divert water to individual reservoirs in the fountain as water is inconsistently expelled by the reservoirs. For example, depending on the display being generated, each reservoir can have its own unique, time-based demand for re-supply of water as the fountain operates.

In short, conventional gravity flow fountains are ill-equipped to provide a varying, yet efficient and timely, supply of water to each individual reservoir as fluid is non-constantly expelled from different reservoirs during fountain operation. Thus, a method and apparatus capable of anticipating or predicting water supply needs, and fulfilling those needs, would be highly desirable.

SUMMARY OF THE INVENTION

In one aspect, the invention provides a method of supplying fluid to a gravity flow fountain on an anticipated basis. The method comprises providing an apparatus having a manifold, a fluid fill valve, and a programmable logic device. The manifold includes a reservoir capable of receiving and expelling the fluid, the fluid fill valve is associated with the manifold and capable of providing the reservoir with the fluid, and the programmable logic device is associated with the fluid fill valve.

A display to be generated by the gravity flow fountain is selected and, based on the selected display, a desired fluid level for the reservoir is anticipated. The anticipated desired fluid level is then programmed programmable logic device and the fountain operated. As the fountain is operated, the fluid is expelled from the reservoir to generate the selected display. Therefore, the fluid fill valve is actuated, based on the anticipated desired fluid level programmed into the programmable logic device, to maintain the anticipated desired fluid level within the reservoir. Thus, the fluid is supplied to the fountain on the "anticipated" basis.

The apparatus can further comprise a valve assembly within the manifold. The valve assembly is capable of regulating the fluid expelled by the reservoir. Further, the valve assembly can comprise a pintle that permits formation of the selected display or a solenoid capable of being selectively energized by a transistor driver associated with the programmable logic device.

In another embodiment, the invention discloses a method of supplying a fluid to a gravity flow fountain on a historical basis. The method comprises providing an apparatus having a manifold, a fluid fill valve, and a programmable logic device.

The manifold includes a reservoir, a valve assembly, and a sensor. The reservoir is capable of receiving the fluid. The valve assembly has a selectively actuatable solenoid that permits the valve assembly to expel the fluid from the reservoir when the solenoid is actuated. The sensor is capable of sensing historical data within the manifold.

The fluid fill valve is associated with the manifold and is capable of providing the reservoir with the fluid. The programmable logic device includes a memory and is associated with the solenoid, the sensor, and the fluid fill valve.

A display to be generated by the fountain is selected, the fountain is operated thereby selectively actuating the solenoid and permitting the valve assembly to expel the fluid from the reservoir, and the selected display is generated. The historical data within the manifold is sensed with the sensor as the fountain operates and stored in the memory. Thereafter, the operation of the fountain is terminated. Then, based on the historical data stored in the memory, a desired fluid level for the reservoir is determined and programmed into the programmable logic device.

Operation of the fountain is resumed, thereby selectively actuating the solenoid and permitting the valve assembly to expel the fluid from the reservoir, and the selected display is once again generated. Therefore, the fluid fill valve is actuated, based on the desired fluid level programmed into the programmable logic device, to maintain the desired fluid level within the reservoir as the fountain is operated. Thus, the fluid is supplied to the fountain on a "historical" basis.

The historical data can include a solenoid firing sequence within the manifold or fluid depth, height, weight, or rate of the fluid received within the reservoir.

In a further embodiment, the invention discloses a method of supplying a fluid to a gravity flow fountain on a real time basis. The method comprises providing an apparatus including a manifold, a fill valve, and a programmable logic device.

The manifold has a reservoir, a valve assembly, and a sensor. The reservoir is capable of receiving the fluid. The valve assembly contains a selectively actuatable solenoid that permits the valve assembly to expel the fluid from the reservoir when the solenoid is actuated. The sensor is capable of sensing data within the manifold.

The fluid fill valve is associated with the manifold and is capable of providing the reservoir with the fluid. The programmable logic device has a memory and is associated with the solenoid, the sensor, and the fluid fill valve.

A desired fluid level to be maintained within the reservoir in the manifold is determined and programmed into the memory of the programmable logic device. Thereafter, the fountain is operated and the data within the manifold is sensed with the sensor. Using the programmable logic device, the sensed data is compared with the desired fluid level data that is stored in the memory. Based on the comparison of the sensed data and the desired fluid level, the fluid fill valve is actuated to maintain the desired fluid level within the reservoir as the fountain is operated. Thus, the fluid is supplied to the fountain on a "real time" basis.

The sensed data can be stored in the memory and a transistor driver that is instructed by the programmable logic device can perform the actuating. The fluid can be water or a mixture of water and an additive. Additives can be used to control a property of the mixture such as odor, color, viscosity, purity, appearance, temperature, freezing point, flavor, and reflectivity.

The programmable logic device can be associated with another programmable logic device, a network server, a hub, a network, and the Internet. The manifold can contain a seal having seal apertures therein while the valve assembly can include pintles. The pintles can alternatively rest within the seal apertures to prohibit expulsion of the fluid or can disengage from the seal apertures to permit expulsion of the fluid. A bottom of the manifold can contain bottom apertures having nozzles therein. The nozzles are capable of directing the fluid expelled from the reservoir. The bottom apertures can contain a salient disposed therein to prohibit pintles from further receipt into the bottom apertures at an equal depth.

In another aspect, the invention discloses a system for maintaining a desired fluid level in a gravity flow fountain. The system comprises a plurality of manifolds, sensors, fluid fill valves, a base, a pump, and a plurality of programmable logic devices.

The manifolds can include a reservoir for receiving and expelling a fluid. Sensors can be associated with each of the manifolds and each sensor is capable of collecting data within at least one of the manifolds. Fluid fill valves can be associated with each of the manifolds and each of the fluid fill valve is capable of selectively supplying the fluid to at least one of the reservoirs within the manifolds.

The base for receives the fluid expelled by the reservoirs. The pump is associated with the base and the fluid fill valve such that the pump is capable of receiving water from the base and providing water to the fill valve. Each of the programmable logic devices is associated with at least one of the manifolds, at least one of the sensors, and at least one of the fluid fill valves.

When the fountain is operated, the sensors sense the data as the fluid is expelled by the reservoirs, the sensed data is compared with the desired fluid levels by the programmable logic device, and the fluid fill valves are selectively actuated by the programmable logic device to increase or decrease the fluid received by the reservoirs. As such, the desired fluid levels in the reservoirs of the fountain are maintained.

The system can include a hub, a network server, and a network in association with the plurality of programmable logic devices. The system can also contain a manifold support apparatus that elevates the manifolds vertically above the base. The system is capable of compensating for valve assembly malfunctions, pump inefficiencies, and leaks in fountain components. To reduce noise generated by a valve assembly in the manifold, the valve assembly can include a dampening plate.

Various other features, objects and advantages of the present invention will be made apparent from the following detailed description and the drawings.

BRIEF DESCRIPTION OF THE DRAWINGS

Embodiments of the invention are described below with reference to the following accompanying drawings, which are for illustrative purposes only. The invention is not limited in its application to the details of construction or the arrangement of the components set forth in the following description or illustrated in the drawings. The invention is capable of other embodiments or of being practiced or carried out in other various ways. Like reference numerals are used to indicate like components.

DETAILED DESCRIPTION

Figure 1:
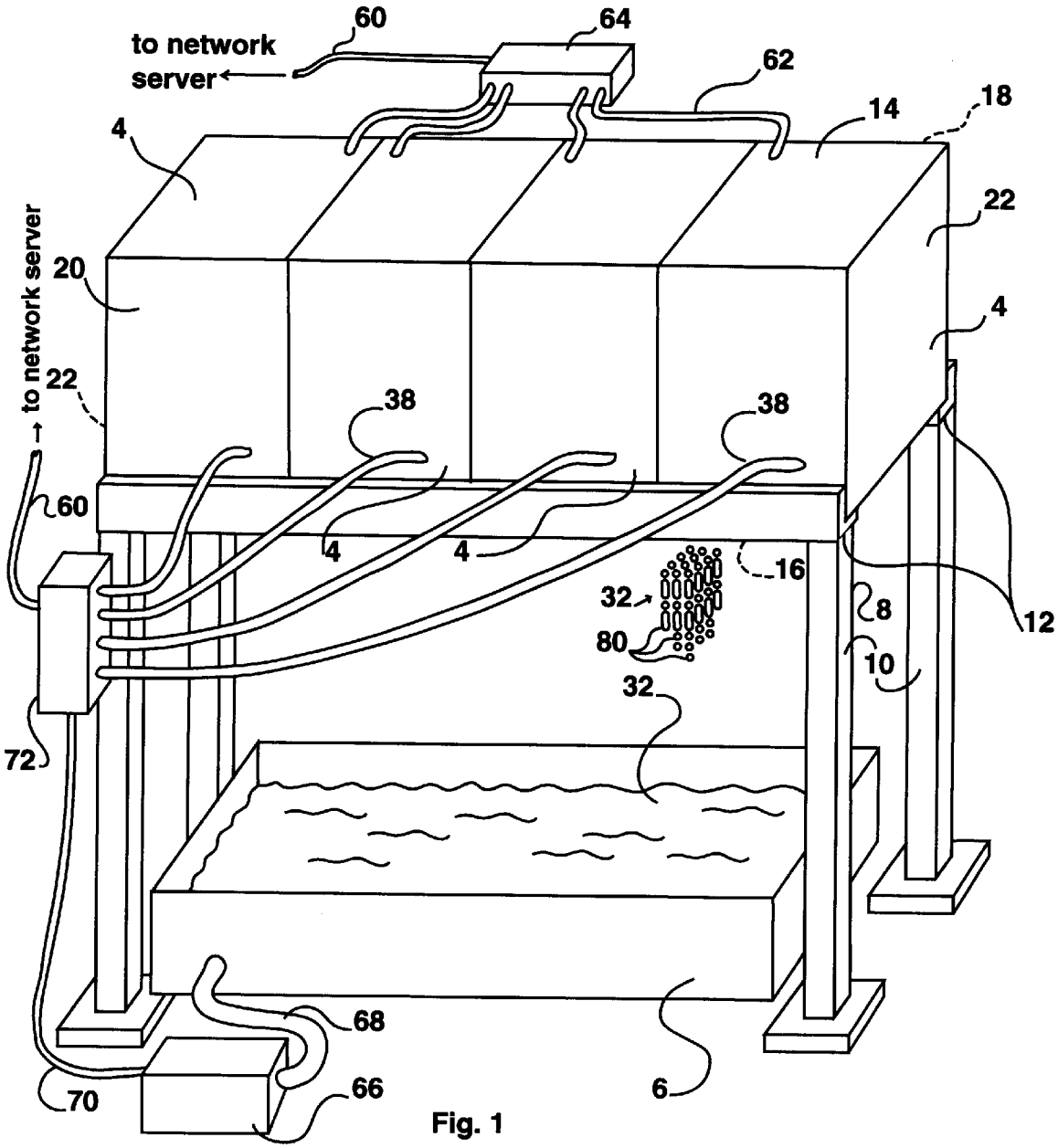
FIG. 1 is a perspective view of a gravity flow fountain in operation.

Referring to FIG. 1, a gravity flow fountain 2 comprises a plurality of manifolds 4 secured above a base 6 by a manifold support apparatus 8. Manifold support apparatus 8 comprises one or more manifold stands 10 secured to opposing, angled flanges 12, such that the manifold support apparatus can receive the manifolds 4. Manifolds 4 resting in manifold support apparatus 8 are, in preferred embodiments, minimally displaced from adjacent manifolds.

Figure 2:
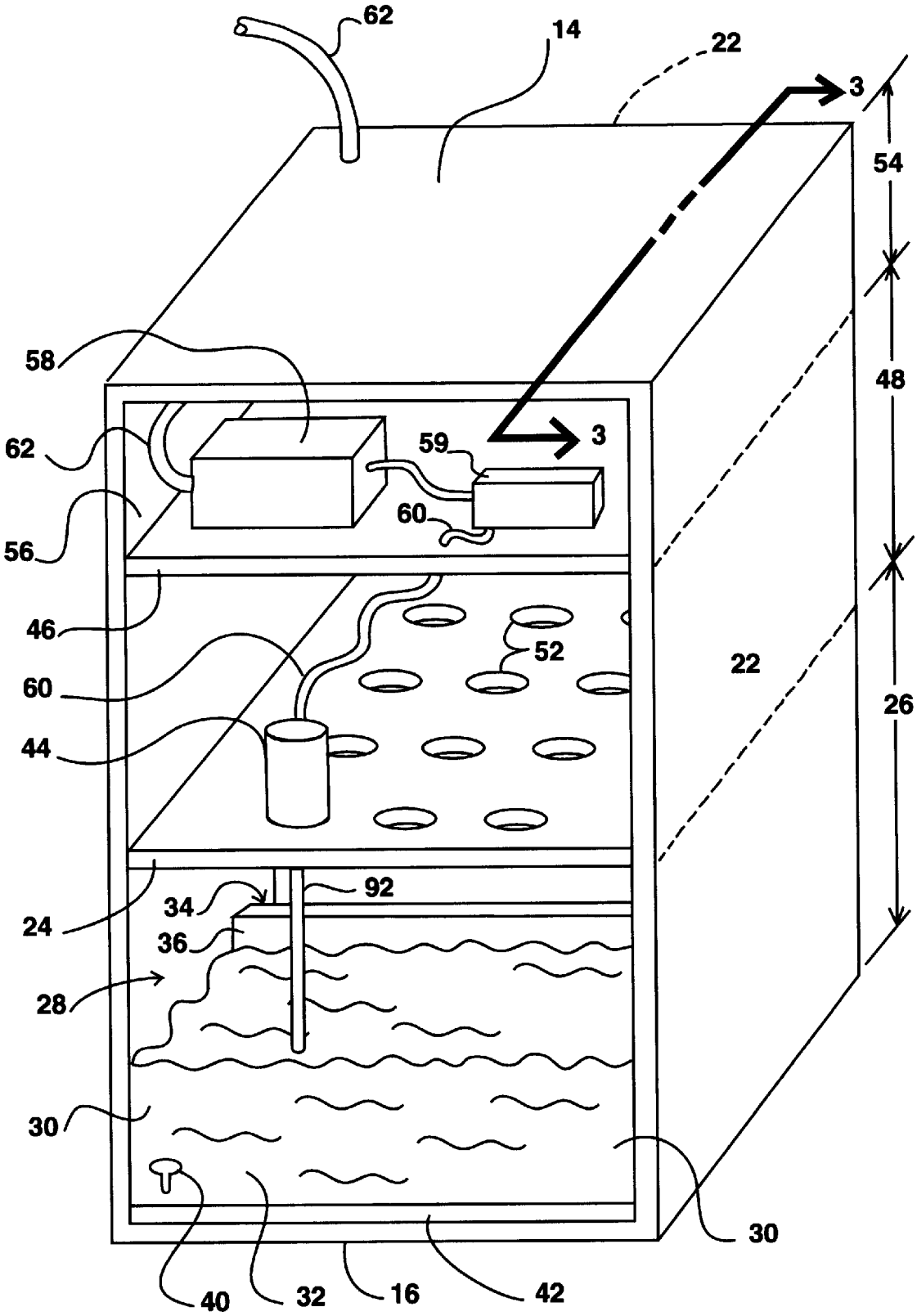
FIG. 2 is a perspective view of one embodiment of a manifold, with the manifold front wall removed, used within the fountain of FIG. 1.

As illustrated in FIG. 2, manifold 4 comprises manifold top 14, manifold bottom 16, manifold front wall 18, manifold back wall 20, and manifold side walls 22. Typically, manifold front wall 18 and manifold back wall 20 are constructed of rigid, water-tight material (e.g., polyvinyl chloride, etc.) while manifold side walls 22 are constructed of a water-tight, pressed metal (e.g., aluminum, etc.).

Figure 3:
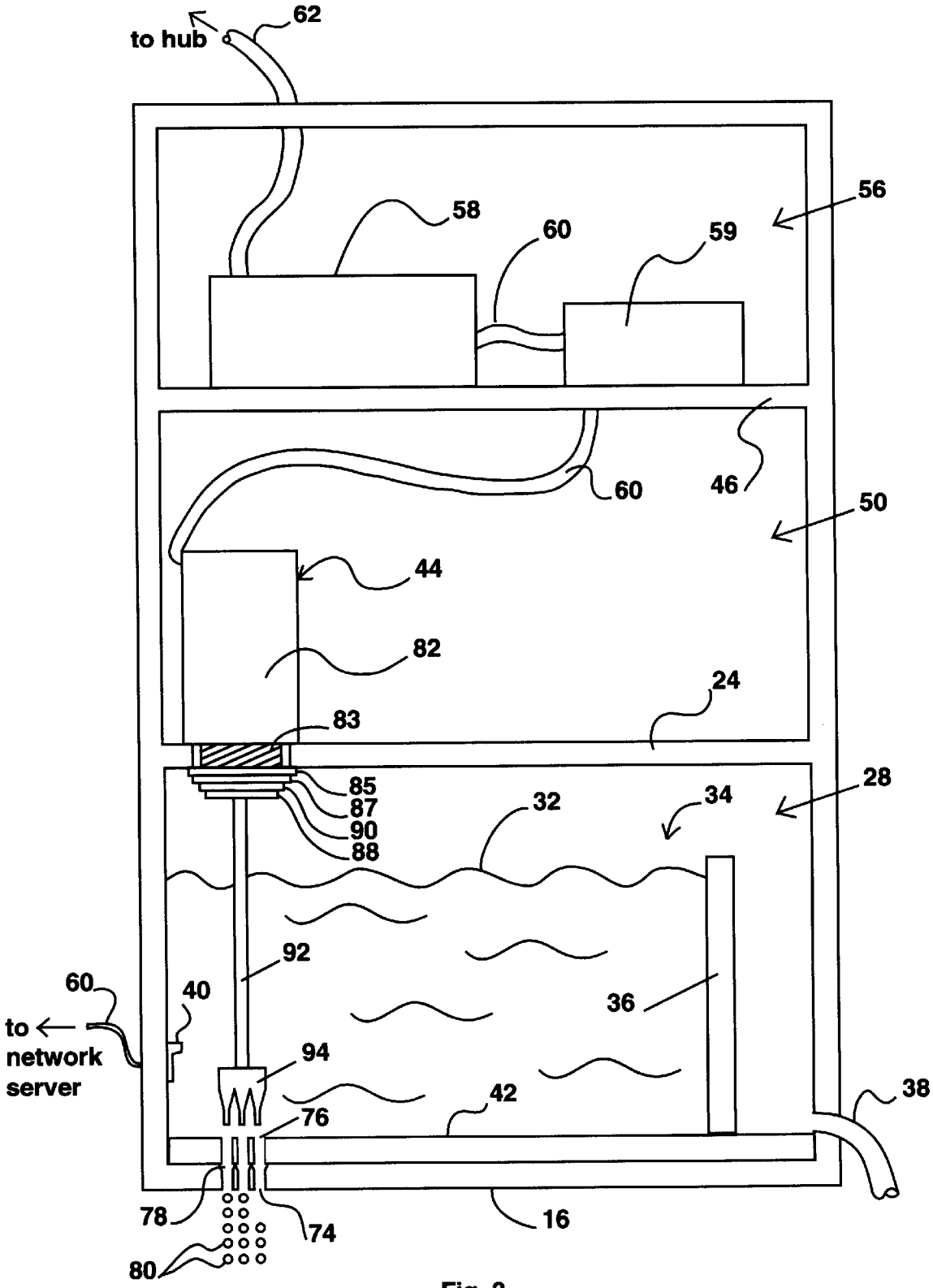
FIG. 3 is a side elevational, cross-sectional view of the manifold of FIG. 2 taken along line 3—3.

Still referring to FIG. 2, valve assembly mantle 24 defines, along with manifold bottom 16 and lower manifold portion 26 of manifold side walls 22, manifold front wall 18, and manifold back wall 20, reservoir chamber 28. As illustrated in FIGS. 2 and 3, reservoir chamber 28 contains reservoir 30, for storing water 32, overflow weir 34, having weir wall 36, fluid supply tube 38, one or more sensors 40, seal 42, and one or more lower portions of valve assemblies 44.

Droplet control system mantle 46 defines, along with valve assembly mantle 24 and middle manifold portion 48 of manifold side walls 22, manifold front wall 18, and manifold back wall 20, valve assembly support chamber 50. Droplet control system mantle 46 contains a plurality of valve assembly apertures 52 extending therethrough. Valve assembly support chamber 50 houses a plurality of valve assemblies 44 that can be received in valve assembly apertures 52. Thus, a lower portion of each valve assembly is located in reservoir chamber 28 and an upper portion is located in valve assembly support chamber 50.

Droplet control system mantle 46 defines, along with manifold top 14 and upper manifold portion 54 of manifold side walls 22, manifold front wall 18, and manifold back wall 20, droplet control system chamber 56. Droplet control system chamber 56 includes one or more programmable logic devices 58 and one or more transistor drivers 59. Programmable logic devices 58 can comprise a variety of programmable logic circuits, a typical personal computer, an industrial controller, an imbedded microprocessor, or other like devices. In a preferred embodiment, an imbedded microprocessor manufactured by can be employed as the programmable logic device. Transistor driver 59 can comprise a variety of drivers, a solid state relay driver, or other like devices.

Programmable logic device 58 and transistor driver 59 are associated through an electrical connection 60 to one or more valve assemblies 44. In combination, programmable logic device 58 and transistor driver 59 can transmit instructions, actuate, and/or manipulate valve assemblies 44. Further, programmable logic device 58 and/or transistor 59 can be connected through programmable logic device line 62 to hub 64, a network server (not shown), one or more networks, the Internet, and the like.

Referring to FIG. 1, hub 64 (or other like device) receives information from, and supplies information to, each programmable logic device 58 in the plurality of manifolds 4 through the programmable logic device lines 62. Hub 64 can be connected to programmable logic device 58, transistor driver 59, a network server (not shown), one or more networks, the Internet, and the like, by electrical connection 60.

Referring back to FIG. 1, gravity flow fountain 2 further comprises pump 66. Pump 66 can be associated with base 6 by pump inlet tube 68 such that the pump is provided a supply of water 32 from the base. Pump 66 discharges water 32 through pump outlet tube 70 to provide fluid fill valve 72 with water 32. Fluid fill valve 72 selectively expels water 32 through one or more fluid supply tubes 38. Fluid fill valve 72 can be associated with, and controlled by, a network server (not shown), programmable logic device 58, and the like. Although a single fluid fill valve 72 is illustrated, a plurality of fluid fill valves can be employed. In such embodiments, each manifold 4 can be associated with one or more fluid fill valves 72.

Each fluid supply tube 38 is connected to one of manifolds 4 proximate overflow weir 34 as shown in FIG. 3. When water 32 expelled by fluid fill valve 72 reaches one of manifolds 4, the water can enter the manifolds by flowing over weir wall 36 and splashing into reservoir 30. Also, when water 32 within reservoir 30 becomes overabundant, the water can flow over weir wall 36 and be expelled from the reservoir through a drain (not shown) or otherwise re-routed within fountain 2.

As illustrated in FIG. 3, manifold bottom 16 comprises a plurality of bottom apertures 74 extending therethrough. Disposed above manifold bottom 16, within the reservoir chamber 28, is seal 42. Seal 42 comprises a plurality of seal apertures 76. Seal apertures 76 and bottom apertures 74 are typically aligned with each other. The volume within each seal aperture 76 and bottom aperture 74 defines droplet cavity 78. Droplet cavity 78 provides a location for the formation of water droplets 80. Water droplets 80 can be expelled from reservoir 30 through seal apertures 76 and bottom apertures 74.

Again referring to FIG. 3, located within manifold 4 is sensor 40. Sensor 40 is capable of detecting data such as one or more fluid properties (e.g., a water level, depth, weight, and/or rate of flow) and/or other manifold data. Sensor 40 can thereafter relay that data, through an electrical connection 60, to a programmable logic device 58, a hub 64, and a network server (not shown). Sensor 40 may be immersed in, or proximate, water 32 in reservoir 30. Although a single sensor is shown in FIG. 3, a plurality of sensors, monitoring one or more different water properties, can be employed within fountain 2. In preferred embodiments, a plurality of sensors 40 can be interconnected and in communication with each other. Further, each of the sensors 40 can be associated with programmable logic device line 62, hub 64, a network server (not shown), one or more networks, the Internet, and the like.

Figure 4:
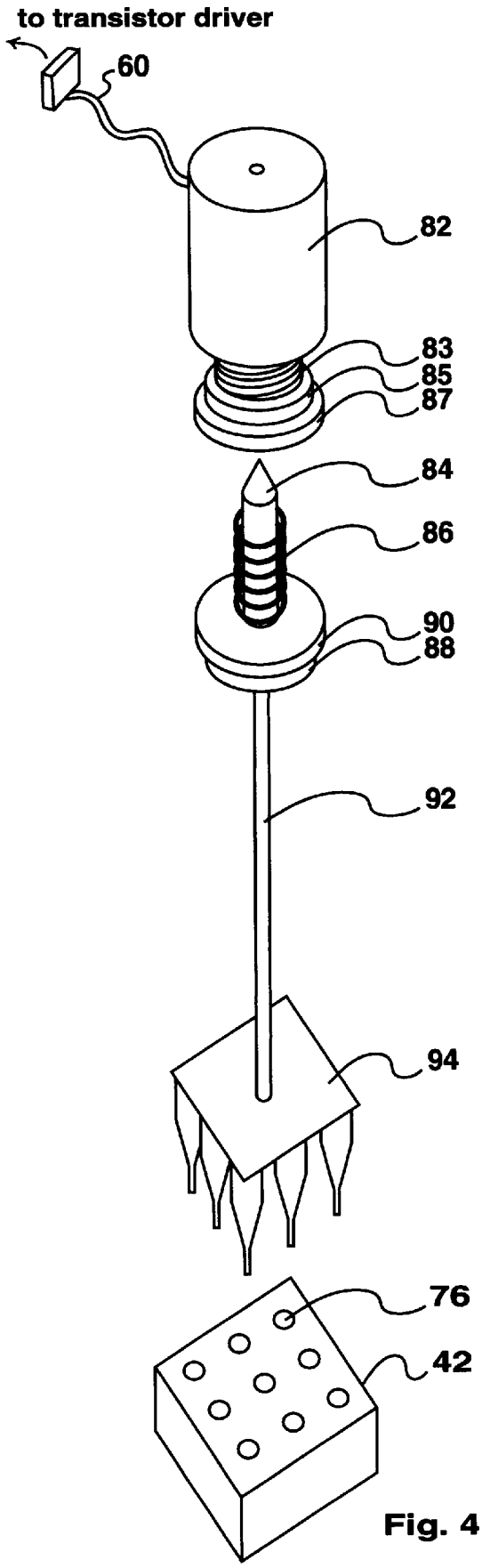
FIG. 4 is a partially exploded, perspective view of a valve assembly, disposed above a seal with a plurality of seal apertures, employed within the manifold of FIG. 2.

Referring to FIG. 4, each valve assembly 44 comprises solenoid 82, electrical connection 60, armature 84, coil 86, stiff plate 88, dampening plate 90, shaft 92, and comb pintle 94. Solenoid 82 includes threaded lower portion 83. Threaded lower portion 83 is smaller in circumference than solenoid 82 and can be received in one of valve assembly apertures 52 within valve assembly mantle 24 (FIG. 2). Lock washer 85 and nut 87 can thereafter secure solenoid 82 to valve assembly mantle 24.

Armature 84 and coil 86 can be received, at varying depths, upwardly into a recess (not shown) in solenoid 82. Shaft 92 connects comb pintle 94 to stiff plate 88. Electrical connection 60 connects solenoid 82 to transistor driver 59 such that the solenoid can be selectively energized. As solenoid 82 is energized, armature 84 and coil 86 are drawn upwardly into the recess (not shown) in solenoid 82. When solenoid 82 is not being energized, armature 84 and coil 86 fall downwardly due to the pull of gravity permitting comb pintle 94 to rest within seal apertures 76. Thus, as solenoid 82 is selectively energized and de-energized, valve assembly 44 is actuated causing comb pintle 94 to be raised or lowered. In preferred embodiments, stiff plate 88 can receive thereon dampening plate 90. Dampening plate 90 is typically constructed of a compressible material (e.g., rubber) to muffle the sound of the stiff plate striking nut 87, solenoid 44, or the like.

Figure 6A:
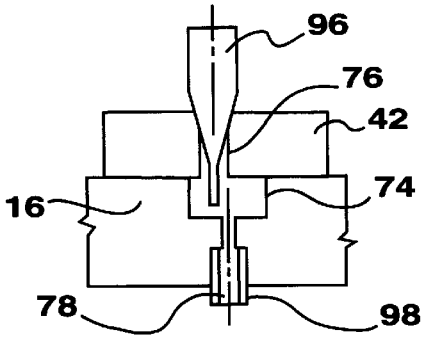
FIG. 6*a* is an elevational, cross-sectional view of one embodiment of a manifold bottom as a single pintle, from the comb pintle of FIG. 5, engages the seal and the manifold bottom, the manifold bottom having a nozzle therein.
Figure 6B:
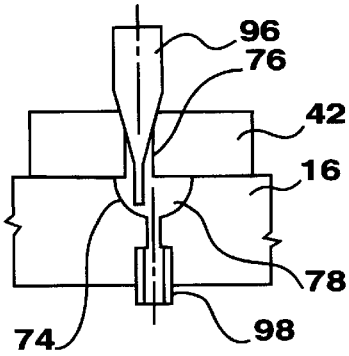
FIG. 6*b* is an elevational, cross-sectional view of another embodiment of a manifold bottom as a single pintle, from the comb pintle of FIG. 5, engages the seal and the manifold bottom, the manifold bottom having a nozzle therein.
Figure 6C:
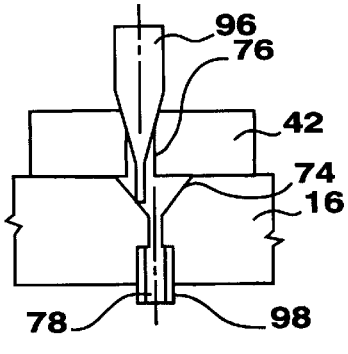
FIG. 6*c* is an elevational, cross-sectional view of another embodiment of a manifold bottom as a single pintle, from the comb pintle of FIG. 5, engages the seal and the manifold bottom, the manifold bottom having a nozzle therein.

As illustrated in FIGS. 6*a*, 6*b*, and 6*c*, the cross-section of various bottom apertures 74, or portions thereof, can comprise a square, a rectangle, a semi-circle, or a triangle. In addition to those shapes illustrated, other shapes are contemplated. Each bottom aperture 74 can be machined to a common depth such that each pintle 96 in comb pintle 94 is dissuaded from further entering the bottom aperture at the same depth. In some embodiments, bottom apertures 74 can receive-tubes, rings, or other objects to form nozzles 98. Nozzles 98 are received by, and disposed within, bottom apertures 74 to divert or alter the path of water 32 being expelled from reservoir 30 and/or manifold 4. Nozzles 98 can be angled or bent with respect to the axis of the tube such that the water droplet can be released in varying directions. Nozzles 98 can be a variety of nozzles known in the relevant art to provide a laminar flow, a spray, a mist, or other fluid stream.

Figure 5:
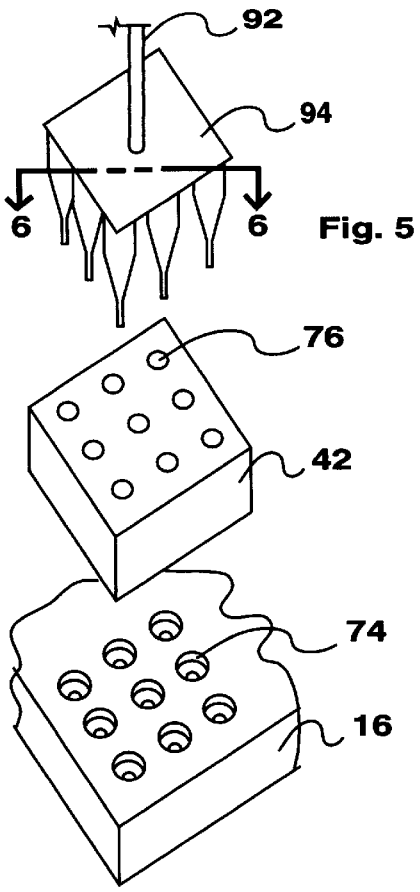
FIG. 5 is an exploded, perspective view of a comb pintle, used with the valve assembly and the seal of FIG. 4, as well as a manifold bottom with a plurality of bottom apertures.
Figure 7:
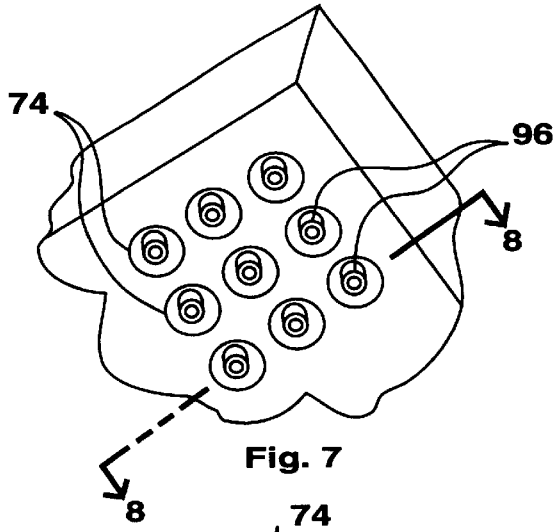
FIG. 7 is a perspective view of the underside of the manifold bottom of FIG. 5 illustrating the comb pintle received within the bottom apertures within the manifold bottom.
Figure 8:
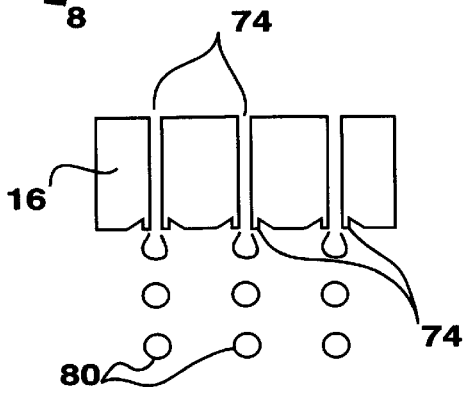
FIG. 8 is a side elevational, cross-sectional view of the manifold bottom and bottom apertures of FIG. 5 taken along line 8—8 illustrating an integrally formed nozzle.

Referring to FIG. 5, the association of comb pintle 94, seal 42, and manifold bottom 16 is illustrated. When comb pintle 94 is removed from both seal apertures 76 and bottom apertures 74, the unobstructed droplet cavity 78 permits water 32 to be expelled from reservoir 30. In contrast, as comb pintle 94 engages either or both of seal apertures 76 and bottom apertures 74, the droplet cavity 78 is blocked and water 32 is retained in reservoir 30.

The operation of a typical gravity flow fountain is described in U.S. Pat. No. 4,294,406 to Pevnick and is incorporated herein by this reference. With regard to the present invention, the pull of gravity acting on water 32 in droplet cavity 78 urges water droplets 80 to be expelled, the water droplets fall from reservoir 30, and are thereafter received by base 6. Droplets aggregate with water 32 already present in base 6 and, as necessary, the water 32 can be routed back to reservoirs 30 for further formation and release. As this process is repeated and choreographed, fountain 2 becomes capable of forming displays, images, and/or messages as long as an adequate supply of water 32 is received by reservoirs 30. Even though water 32 used by fountain 2 is non-constant and varying, the water is controllable and, therefore, predictable.

The amount of water 32 a particular reservoir 30 contains, over time, is a function of two major factors. The first factor is the design to be created by the fountain 2. In other words, the volume of water 32 being expelled from a reservoir 30 at a given time. The second factor is the rate at which water 32 can be delivered to a reservoir 30 in a particular manifold 4. In other words, the rate at which expelled water 32 can be replaced. By incorporating a programmable logic device 58 into each manifold 4, solenoid 82 activity can be controlled and data regarding the frequency of solenoid 82 actuation, as well as the length of time droplet cavities 78 remain open, can be collected and stored. With this data, the volume of water 32 used by each manifold 4, over time, can be calculated. In turn, this data can be shared with programmable logic devices 58 located in other manifolds 4, with a hub, a network server, and the like.

Since the volume of water 32 that is being expelled from an individual manifold 4 can be calculated or is known, a fluid fill valve 72 can be selectively operated to supply water to one or more reservoirs 30. The fluid fill valve 72 can receive instructions for operation from one or more programmable logic devices 58 and/or from a network server. Thus, water 32 can be quickly supplied to an individual manifold 4 before that manifold has drained its reservoir 30 of water 32.

Several methods for supplying water 32 to individual reservoirs 30 are contemplated. In one embodiment, a desired fluid level for each reservoir 30 is determined prior to, the operation of the fountain 2. The desired fluid level can be any level, amount, and/or rate of fluid that the operator of the fountain, the programmable logic device, and the like, chooses and/or selects as the level of fluid to be substantially maintained in the reservoir. For example, the desired fluid level can be based on a water height, depth, volume, and the like.

After the desired fluid level is determined, a fountain operator selects the display to be generated by the fountain 2 and, considering that display, anticipates and/or predicts the amount of water 32 that each reservoir 30 will require, over time, as the fountain operates. The anticipated amount of water 32 can be programmed into programmable logic device 58 to direct an increased or decreased amount of water to individual reservoirs 30. Thus, water 32 can be effectively routed on an "anticipated" basis to substantially maintain the desired fluid level in reservoir 30, and as such, fountain 2 can more efficiently and effectively use the water.

In another embodiment, the desired fluid levels can be determined by first operating the gravity flow fountain 2. As fountain 2 operates, data such as the sequence of solenoid 82 firing and/or water levels in reservoirs 30 can be collected and stored in a memory. This can be accomplished by using sensors 40, programmable logic device 58, a network server, and the like. Thereafter, the operation of the fountain 2 can be terminated and the desired fluid levels determined based on the data in the memory. After the desired fluid levels are determined, the desired fluid levels can be programmed into the programmable logic device 58 and operation of the fountain 2 can resume, possibly at a much later date. As fountain 2 once again operates, the fluid level information is retrieved from memory and water is accordingly delivered. Thus, water 32 can be effectively routed on a "historical" basis to substantially maintain the desired fluid level in the reservoir 30.

Fountain 2 can also operate such that water 32 is supplied to reservoirs 30 on a "real time" basis. In other words, the desired fluid levels can be continually updated and compared to sensed fluid levels. This embodiment differs from previous embodiments in that the sensed fluid levels are sensed prior to desired levels being determined. As such, the fountain 2 uses the information collected by the sensor 40, as the fountain is operating, to determine desired levels. In this embodiment, during fountain operations, one or more sensors 40 senses one or more water properties within reservoir 30 as fluid is being expelled. The sensed water property is then relayed to the programmable logic device 58 and compared with previously determined criteria such as, for example, the desired fluid level. If the sensed fluid level differs from the desired fluid level, fluid fill valve 72 can be actuated to either permit or restrict the flow of water 32 into reservoir 30. Thus, water 32 can be effectively routed on a "real time " basis to substantially maintain the desired fluid level in the reservoir 30.

When the "real time" method of supplying water is used, unexpected difficulties that can affect the amount of water in the reservoirs, such as valve assembly malfunctions, pump inefficiencies, leaks in fountain components, and the like, can be compensated for.

In one embodiment, a plurality of pumps, similar to pump 66, can be employed within fountain 2 in lieu of fluid fill valve 72. Each pump can be directly connected to an associated reservoir 30. Instead of controlling a fluid fill valve 72, programmable logic device 58 and/or a network server can instruct the individual pumps 66 to operate as necessary to supply water 32. In alternative embodiments, other devices can be utilized to fill reservoirs 30 such as, for example, a hamster feeder, a water tower, and the like.

If desired, an additive can be added to water 32 (or other fluid) used within fountain 2. Such additives can affect odor, color, viscosity, purity, appearance, temperature, freezing point, flavor, or reflectivity of water 32.

When the above-described methods are utilized, water 32 can be supplied to individual reservoirs 30 on a "anticipated", "historical", or "real-time" basis. Thus, the efficiency of water routing in gravity flow fountains 2 is greatly enhanced. While water supply methods have been described herein with respect to gravity flow fountain 2, other fountains, for example, pressurized fountains, can also be used.

Although water 32 has been used as the preferred embodiment throughout the description, it is contemplated that other fluids (e.g., oils) can be used. Also, for example, commercial beverages such as soda, sports drinks, tea, coffee, and other commercial products, can be used, to encourage advertising.

In compliance with applicable statutes, the invention has been described in language more or less specific as to structural and methodical features. It is to be understood, however, that the invention is not limited to the specific features shown and described. The present invention has been described in terms of the preferred embodiment, and it is recognized that equivalents, alternatives, and modifications, aside from those expressly stated, are possible and within the scope of the appending claims.

What is claimed is:

1. A method of supplying fluid to a gravity flow fountain on an anticipated basis, the method comprising:

providing an apparatus comprising:

a manifold, the manifold having a reservoir capable of receiving and expelling the fluid;

a fluid fill valve associated with the manifold, the fluid fill valve capable of providing the reservoir with the fluid; and a programmable logic device, the programmable logic device associated with the fluid fill valve;

selecting a display to be generated by the gravity flow fountain;

anticipating, based on the selected display, a desired fluid level for the reservoir;

programming the anticipated desired fluid level into the programmable logic device;

operating the fountain, thereby expelling the fluid from the reservoir, to generate the selected display;

actuating the fluid fill valve, based on the anticipated desired fluid level programmed into the programmable logic device, to maintain the anticipated desired fluid level within the reservoir as the fountain is operated and thereby supplying the fluid to the fountain on the anticipated basis.

2. The method of claim 1, wherein the apparatus further comprises a valve assembly within the manifold, the valve assembly capable of regulating the fluid expelled by the reservoir.

3. The method of claim 2, wherein the valve assembly comprises a pintle, the pintle permitting formation of the selected display.

4. The method of claim 1, wherein the valve assembly further comprises a solenoid, the solenoid capable of being selectively energized by a transistor driver associated with the programmable logic device to form the selected display.

5. A method of supplying a fluid to a gravity flow fountain on a historical basis, the method comprising:

providing an apparatus comprising:

a manifold, the manifold having:

a reservoir, the reservoir capable of receiving the fluid;

a valve assembly with a selectively actuatable solenoid, the solenoid permitting the valve assembly to expel the fluid from the reservoir when the solenoid is actuated;

a sensor, the sensor capable of sensing historical data within the manifold;

a fluid fill valve associated with the manifold, the fluid fill valve capable of providing the reservoir with the fluid; and a programmable logic device having a memory, the programmable logic device associated with the solenoid, the sensor, and the fluid fill valve;

selecting a display to be generated by the fountain;

operating the fountain, thereby selectively actuating the solenoid and permitting the valve assembly to expel the fluid from the reservoir, to generate the selected display;

sensing the historical data within the manifold with the sensor as the fountain operates and storing the sensed historical data in the memory;

terminating operation of the fountain;

determining, based on the historical data stored in the memory, a desired fluid level for the reservoir;

programming the desired fluid level into the programmable logic device;

operating the fountain, thereby selectively actuating the solenoid and permitting the valve assembly to expel the fluid from the reservoir, to generate the selected display;

actuating the fluid fill valve, based on the desired fluid level programmed into the programmable logic device, to maintain the desired fluid level within the reservoir as the fountain is operated thereby supplying the fluid to the fountain on the historical basis.

6. The method of claim 5, wherein the historical data is a solenoid firing sequence of the solenoid within the manifold.

7. The method of claim 5, wherein the historical data is one of depth of the fluid in the reservoir, height of the fluid within the reservoir, weight of the fluid within the reservoir, or rate of the fluid received within the reservoir.

8. A method of supplying a fluid to a gravity flow fountain on a real time basis, the method comprising:

providing an apparatus comprising:

a manifold, the manifold having:

a reservoir, the reservoir capable of receiving the fluid;

a valve assembly with a selectively actuatable solenoid, the solenoid permitting the valve assembly to expel the fluid from the reservoir when the solenoid is actuated;

a sensor, the sensor capable of sensing data within the manifold;

a fluid fill valve associated with the manifold, the fluid fill valve capable of providing the reservoir with the fluid; and a programmable logic device having a memory, the programmable logic device associated with the solenoid, the sensor, and the fluid fill valve;

determining a desired fluid level to be maintained within the reservoir in the manifold, programming the desired fluid level into the memory of the programmable logic device, and operating the fountain;

sensing the data within the manifold with the sensor as the fountain is operated;

comparing, using the programmable logic device, the sensed data with the desired fluid level data stored in the memory; and actuating the fluid fill valve, based on the comparison of the sensed data and the desired fluid level, to maintain the desired fluid level within the reservoir as the fountain is operated thereby supplying the fluid to the fountain on the real time basis.

9. The method of claim 8, wherein the sensed data is stored in the memory.

10. The method of claim 8, the actuating is performed by a transistor driver that is instructed by the programmable logic device.

11. The method of claim 8, wherein the fluid is water or a mixture of water and an additive for controlling a property of the mixture consisting of odor, color, viscosity, purity, appearance, temperature, freezing point, flavor, or reflectivity.

12. The method of claim 8, wherein the programmable logic device is associated with at least one of another programmable logic device, a network server, a hub, a network, and the Internet.

13. The method of claim 8, wherein the manifold contains a seal having a plurality of seal apertures therein and the valve assembly further comprises one or more pintles, the one or more pintles alternatively resting within the seal apertures to prohibit the expulsion of the fluid or disengaging from the seal apertures to permit the expulsion of the fluid.

14. The method of claim 8, wherein a bottom of the manifold contains a plurality of bottom apertures having nozzles therein, the nozzles capable of directing the fluid expelled from the reservoir.

15. The method of claim 13, wherein the manifold contains a plurality of bottom apertures, each bottom aperture containing a salient disposed therein such that the one or more pintles are prohibited from further receipt into the bottom apertures at an equal depth.

16. A system for maintaining a desired fluid level in a gravity flow fountain, the system comprising:

a plurality of manifolds, each of the manifolds comprising a reservoir for receiving and expelling a fluid;

a sensor associated with each of the manifolds, each sensor capable of collecting data within at least one of the manifolds;

a fluid fill valve associated with each of the manifolds, each of the fluid fill valves capable of selectively supplying the fluid to at least one of the reservoirs within the manifolds;

a base for receiving the fluid expelled by the reservoirs;

a pump associated with the base and the fluid fill valve, the pump capable of receiving water from the base and providing water to the fill valve;

a plurality of programmable logic devices, each of the programmable logic devices associated with at least one of the manifolds, at least one of the sensors, and at least one of the fluid fill valves;

wherein the fountain is operated, the sensors sense the data as the fluid is expelled by the reservoirs, the sensed data is compared with the desired fluid levels by the programmable logic device, and the fluid fill valves are selectively actuated by the programmable logic device to increase or decrease the fluid received by the reservoirs such that the desired fluid levels in the reservoirs of the fountain are maintained.

17. The system of claim 16, wherein the system further comprises at least one of a hub, a network server, and a network in association with the plurality of programmable logic devices.

18. The system of claim 16, wherein the system further comprises a manifold support apparatus, the manifold support apparatus elevating the plurality of manifolds vertically above the base.

19. The system of claim 16, wherein the system compensates for at least one of a valve assembly malfunction, a pump inefficiency, a leak in a fountain components.

20. The system of claim 16, wherein the manifold further comprises a valve assembly for expelling the fluid from the reservoir, the valve assembly including a dampening plate for reducing noise generated by the valve assembly.

* * * * *